US005491753A

United States Patent [19]

Van Hout et al.

[11] Patent Number: 5,491,753

[45] Date of Patent: Feb. 13, 1996

[54] METHOD AND DEVICE FOR TESTING FOR AUDIO INDUCED SYMPATHETIC BUZZES

[75] Inventors: James E. Van Hout, Auburn Hills; David J. Madaj, Ann Arbor; Roland Holloman, Southfield; Philip A. Kuyava, Troy, all of Mich.

[73] Assignee: Chrysler Corporation, Highland Park, Mich.

[21] Appl. No.: 156,136

[22] Filed: Nov. 22, 1993

[51] Int. Cl.[6] ..... H04R 29/00

[52] U.S. Cl. ..... 381/58; 381/59

[58] Field of Search ..... 381/58–59, 60

[56] References Cited

U.S. PATENT DOCUMENTS

| | | | |
|---|---|---|---|
| 4,306,113 | 12/1981 | Morton | 179/1 |
| 4,674,123 | 6/1987 | Michas | 381/60 |
| 5,113,447 | 5/1992 | Hatley et al. | 381/27 |
| 5,243,327 | 9/1993 | Bentz et al. | 340/566 |
| 5,390,248 | 2/1995 | Segan et al. | 381/58 |

FOREIGN PATENT DOCUMENTS

01288848A1 5/1984 European Pat. Off. .

OTHER PUBLICATIONS

Bass Pacer; Audio Magazine, Apr. 1993, p. 19 European Search Report for EP 94 11 8312.

Howard M. Tremaine, D. Sc., FAES, "Audio Cyclopedia" Howard W. Sams & Co. Inc., 1979, pp. 1118–1121, 1514–1515.

*Primary Examiner*—Stephen Brinich

*Attorney, Agent, or Firm*—Christopher A. Taravella

[57] ABSTRACT

A pre-recorded test tape or test disk which is used to isolate unwanted buzzes in an audio listening environment. The prerecording is a series of varying amplitude frequency sweeps. The frequency sweeps from the audible range of 20 Hz. to 400 Hz., while the amplitude level is set at five different levels. The amplitude of the first sweep is set to the maximum output of the audio system which will give a clean 400 Hz. pre-recorded pallet tone. Each subsequent sweep is 6 dB down from the previous sweep.

9 Claims, 1 Drawing Sheet

METHOD AND DEVICE FOR TESTING FOR AUDIO INDUCED SYMPATHETIC BUZZES

FIELD OF THE INVENTION

The present invention relates to use of tones to isolate unwanted buzzes in an audio listening environment. The present invention also relates to pre-recorded test tapes to produce such tones.

BACKGROUND OF THE INVENTION

Loudspeakers create sympathetic vibrations in neighboring items. This phenomenon is like the sympathetic vibrations induced in a piano string by a tuning fork. The sympathetic vibrations within a audio listening environment are often heard as buzzes that may either seem random or as regular beats in time with musical tones.

In a vehicle, such as an automobile, these buzzes are found in trim panels, door panels, instrument panels, and windows and the associated structures and mechanisms. As audio entertainment systems and communication systems become more powerful, the problem is exacerbated. Automotive engineers find that designing a buzz-free listening environment is quite a challenging endeavor. Conventional designs involve use of stiff structures with an abundance of fasteners and vibration dampening and cushioning materials.

Testing for buzzes has conventionally been carried out by using standard listening devices, such as the radio or tape or CD players. The automotive engineer simply turns on the radio, perhaps to a loud rock station, or the engineer puts on a tape of music with like characteristics. Any buzz readily identified is located and corrected. While this technique works to some extent for major buzzes, the less discernable buzzes are usually masked by tones in the music and voice of regular programming, tapes and recordings. And while small, frequency sensitive buzzes are difficult to locate, they tend to cumulate to bring about a net effect that detracts from the system, both to a listeners consciousness and subconsciousness.

The problem of the sympathetic buzz is exacerbated with light and less expensive (with less materials) automobile as are found in great abundance in today's automotive market.

SUMMARY OF THE INVENTION

An object of the present invention is to provide a prerecorded test tap or test disk to be played in an audio testing environment to isolate buzzes.

In order to achieve the above object, there is provided a pre-recorded test tape or test disk which is used to isolate unwanted buzzes in an audio listening environment. The recording is a series of varying amplitude frequency sweeps. The frequency sweeps from the audible range of 20 Hz. to 400 Hz., while the amplitude level is set at five different levels. The amplitude of the first sweep is set to the maximum output of the audio system which will give a clean 400 Hz. pre-recorded pallet tone. Each subsequent sweep is 6 dB down from the previous sweep.

While the sweeps proceed, the reviewer notices any discernible buzzes or rattles that eminate from the interior of the vehicle due to the audio energy.

BRIEF DESCRIPTION OF THE DRAWINGS

Other objects, features, and advantages of the present invention will become more fully apparent with the following detailed description of the preferred embodiment, the appended claims, and the accompanying drawings in which:

DETAILED DESCRIPTION OF THE PREFERRED EMBODIMENTS

Figure 1:
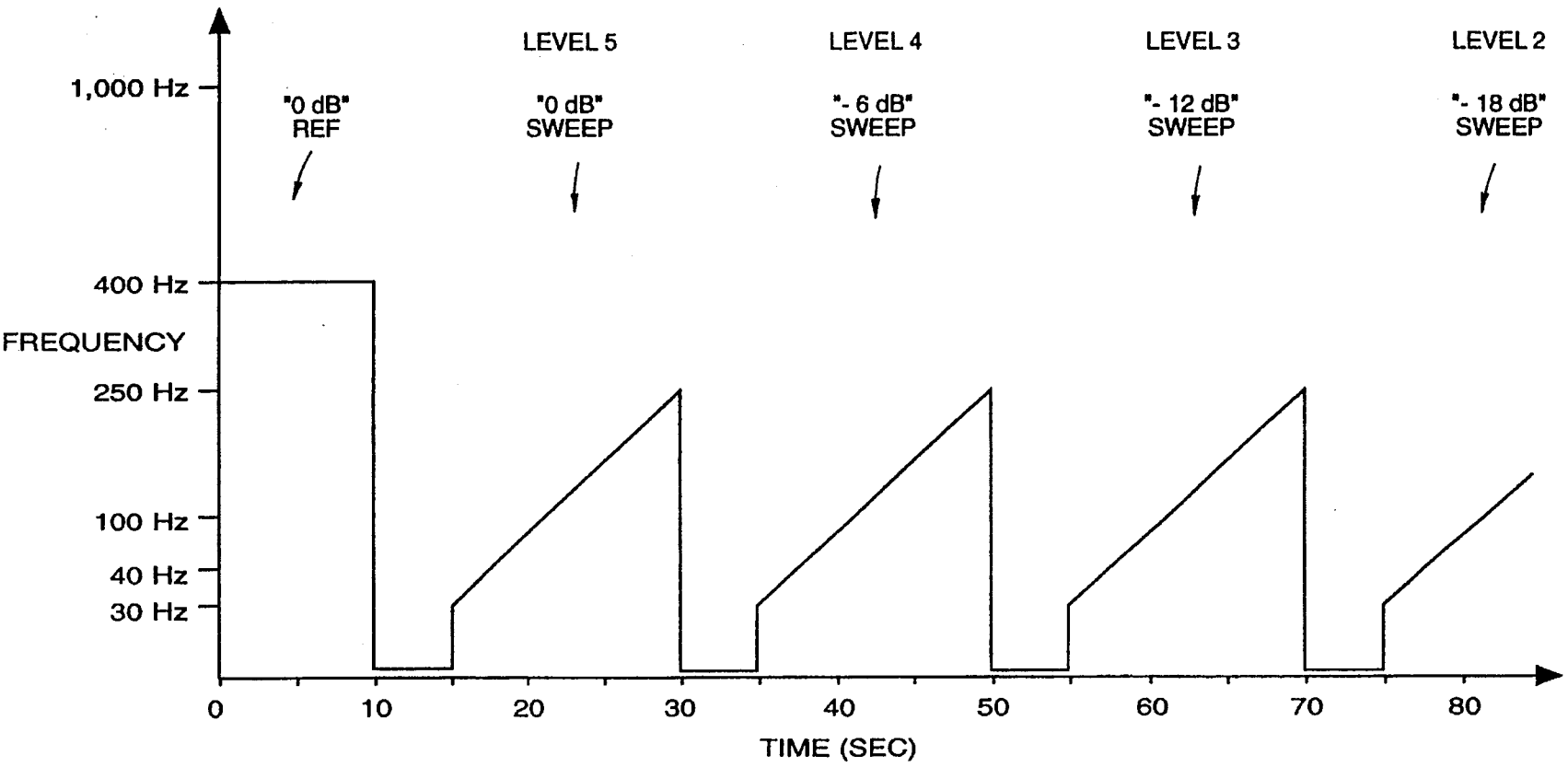
FIG. 1 is a graph showing sweeps at various levels in accordance with the present invention.

The present invention is a pre-recorded test tape or test disk which is used to isolate unwanted buzzes in an audio listening environment. The recording is a series of varying amplitude frequency sweeps. The frequency sweeps from the audible range of 20 Hz. to 400 Hz., while the amplitude level is set at five different levels. The amplitude of the first sweep is set to the maximum output of the audio system which will give a clean 400 HZ. pre-recorded pallet tone. Each subsequent sweep is 6 dE down from the previous sweep.

Reference is made to the drawing. In the drawing, an initial reference tone of 400Hz is recorded at a reference level of 0 dB (200 nWb/m). This corresponds to a level where the tape is near its maximum input capability. This reference level is recorded for a period of 10 seconds, followed by 5 seconds of zero input.

The first sweep starts at 30 Hz and logarithmically increases to 250 Hz over a period of approximately 20 seconds. This sweep is recorded at a 0 dB level and establishes level 5 of the test tape. This is then followed by 5 seconds of zero input.

The second sweep mirrors the first except at a level of −6 dB. This sweep establishes level 5 of the test tape. It is then followed by 5 seconds of zero input.

This pattern continues with level 3 recorded at −12 dB, level 2 recorded at −18 dB, and level 1 at −24 dB with 5 seconds of zero input between the sweeps.

This completes the test sequence, whereas the series can be repeated as necessary or as the length of the test tape allows.

The application of the test tape requires that the playback level be set such that the reference tone of 400 Hz is reproduced at the threshold of output distortion. This is detectable by ear at the point where the pure tone suddenly is Joined by another, higher tone (typically 1200 Hz, the third harmonic). This indicates the maximum clean output of the audio amplifiers and establishes the volume control position to be maintained throughout the remainder of the test.

While the sweeps proceed, the reviewer notices any discernible buzzes or rattles that eminate from the interior of the vehicle due to the audio energy. If a particular level finishes without any noticeable buzzes or rattles, then that level is deemed to be the passing level for that vehicle.

We claim:

1. A device for testing to eliminate loud speaker induced forced sympathetic audible vibrations within a predetermined listening environment comprising:

audio means for responding to an audio means player to produce a pre-recorded signals, said signals including a first audio signal recorded at about 0 dB sweeping from about 30 Hz to about 250 Hz in a time period of about 20 seconds;

a second audio signal recorded at about −6 dB sweeping from about 30 Hz to about 250 Hz in a time period of about 20 seconds;

a third audio signal recorded at about −12 dB sweeping from about 30 Hz to about 250 Hz in a time period of about 20 seconds;

a fourth audio signal recorded at about −18 dB sweeping from about 30 Hz to about 250 Hz in a time period of about 20 seconds; and a fifth audio signal recorded at about −24 dB sweeping from about 30 Hz to about 250 Hz in a time period of about 20 seconds.

2. The device of claim 1 wherein said audio means is an audio tape.

3. The device of claim 1 wherein said audio means is a CD.

4. An audio device for testing to eliminate loud speaker induced forced sympathetic audible vibrations within a predetermined listening environment, the device having recorded thereon at least one audio signal selected from the group consisting of an audio signal recorded at about 0 dB sweeping from about 30 Hz to about 250 Hz in a time period of about 20 seconds, an audio signal recorded at about −6 dB sweeping from about 30 Hz to about 250 Hz in a time period of about 20 seconds, an audio signal recorded at about −12 dB sweeping from about 30 Hz to about 250 Hz in a time period of about −18 dB sweeping from about 30 Hz to about 250 Hz in a time period of about 20 seconds, and an audio signal recorded at about −24 dB sweeping from about 30 Hz to about 250 Hz in a time period of about 20 seconds.

5. The device of claim 4 wherein said audio means is an audio tape.

6. The device of claim 4 wherein said audio means is a CD.

7. A method of locating loud speaker induced forced sympathetic audible vibrations within a predetermined listening environment; comprising the steps of:

generating at least one audio signal selected from the group consisting of an audio signal recorded air about 0 dB sweeping from about 30 Hz to about 250 Hz in a time period of about 20 seconds, an audio signal recorded at about −6 dB sweeping from about 30 Hz to about 250 Hz in a time period of about 20 second, an audio signal recorded at about −12 dB sweeping from about 30 Hz to about 250 Hz in a time period of about 20 seconds, an audio signal recorded at about −18 dB sweeping from about 30 Hz to about 250 Hz in a time period of about 20 seconds, and an audio signal recorded at about −24 dB sweeping from about 30 Hz to about 250 Hz in a time period of about 20 seconds;

locating forced sympathetic audible vibrations induced by said audio signal within said predetermined listening environment.

8. The method of claim 7 wherein said generating step includes the substeps of placing an audio tape in a tape player and playing said tape player, said audio tape having said at least one audio signal recorded thereon.

9. The method of claim 7 wherein said generating step includes the substeps of placing a CD in a CD player and playing said CD player, said CD having said at least one audio signal recorded thereon.

* * * * *